US007919931B2

(12) United States Patent
Kurumisawa

(10) Patent No.: US 7,919,931 B2
(45) Date of Patent: Apr. 5, 2011

(54) LED DRIVING CIRCUIT, ILLUMINATING DEVICE, AND ELECTRO-OPTICAL DEVICE

(75) Inventor: Takashi Kurumisawa, Nagano-ken (JP)

(73) Assignee: Epson Imaging Devices Corporation, Tokyo (JP)

( * ) Notice: Subject to any disclaimer, the term of this patent is extended or adjusted under 35 U.S.C. 154(b) by 1380 days.

(21) Appl. No.: 11/380,050

(22) Filed: Apr. 25, 2006

(65) Prior Publication Data

US 2006/0238465 A1 Oct. 26, 2006

(30) Foreign Application Priority Data

Apr. 26, 2005 (JP) ..... 2005-127484
Dec. 20, 2005 (JP) ..... 2005-365898

(51) Int. Cl.
*H05B 37/02* (2006.01)

(52) U.S. Cl. ..... 315/291; 315/224; 315/312; 345/102; 345/82

(58) Field of Classification Search ..... 345/76–82, 345/204, 690, 102; 315/169.3, 291, 294, 315/224, 307, 312, 324, 362, 363
See application file for complete search history.

(56) References Cited

U.S. PATENT DOCUMENTS

| | | | | |
|---|---|---|---|---|
| 7,535,441 | B2 * | 5/2009 | Smith et al. | 345/76 |
| 2003/0151577 | A1 * | 8/2003 | Morita | 345/89 |
| 2004/0095340 | A1 * | 5/2004 | Nakamura | 345/204 |
| 2006/0071614 | A1 * | 4/2006 | Tripathi et al. | 315/291 |

FOREIGN PATENT DOCUMENTS

| | | |
|---|---|---|
| JP | 01147912 A | 6/1989 |
| JP | 2003-215534 | 7/2003 |

* cited by examiner

*Primary Examiner* — Jacob Y Choi
*Assistant Examiner* — Ephrem Alemu
(74) *Attorney, Agent, or Firm* — Lowe, Hauptman, Ham & Berner, LLP

(57) ABSTRACT

An LED driving circuit for driving a plurality of different LEDs includes: a first power supply circuit that is supplied with an input voltage for generating a plurality of driving voltages and a reference voltage with respect to the input voltage and generates a first output voltage and a second output voltage from the input voltage, on the basis of a first control signal; and a second power supply circuit that is supplied with the first output voltage, the second output voltage, and the reference voltage, selects a voltage for driving the LEDs, on the basis of a second control signal, and outputs them.

8 Claims, 12 Drawing Sheets

LED DRIVING CIRCUIT, ILLUMINATING DEVICE, AND ELECTRO-OPTICAL DEVICE

BACKGROUND

1. Technical Field

The present invention relates to an LED driving circuit, an illuminating device, and an electro-optical device.

2. Related Art

In a backlight of an electro-optical device, such as a liquid crystal display device, instead of a conventional cold cathode fluorescent lamp type, a method using a plurality of LEDs having different emission peak wavelengths, such as red (R), green (G), and blue (B) LEDs, has drawn attention. This method can realize a higher degree of color purity and higher color reproducibility than the cold cathode fluorescent lamp.

The brightness of the LED can be adjusted by a driving voltage supplied to the LED. It is possible to accurately adjust the color of light emitted from the LED and thus to realize high color reproducibility by minutely adjusting the brightness of each LED. That is, it is important to minutely adjust the driving power supplied to the LED in order to improve the display quality of an electro-optical device.

For example, JP-A-2003-215534 discloses a method of improving visibility of a liquid crystal display device and of reducing power consumption by adjusting the driving power supplied to an LED that is used for a backlight of the liquid crystal display device, corresponding to the surrounding brightness.

An LED driving circuit disclosed in JP-A-2003-215534 includes a voltage dividing circuit that divides an input voltage by using a plurality of resistors connected in series to each other and a selection circuit that, when a control signal is supplied, selects one of the divided voltages on the basis of the supplied control signal and outputs the selected voltage. According to this LED driving circuit, since a voltage is selected from a plurality of voltages on the basis of the control signal, it is possible to minutely adjust a driving voltage to be supplied to LEDs so as to correspond to the surrounding brightness.

However, in the above-mentioned LED driving circuit having the voltage dividing circuit, it is necessary to increase the number of resistors constituting the voltage dividing circuit, in order to minutely adjust an output voltage so as to adjust the color of light emitted from the LED.

For example, it is assumed that voltages of 0 V and 4 V are supplied to both ends of the voltage dividing circuit. In this case, twenty resistors are needed in order to output voltages at voltage intervals of 200 mV in the range of 0 V to 4 V. In addition, forty resistors are needed in order to output voltages at voltage intervals of 100 mV in the above-mentioned range.

Therefore, the above-mentioned LED driving circuit has a problem in that larger resistors are needed in order to minutely adjust an output voltage better, which results in an increase in the size of an LED driving circuit.

SUMMARY

An advantage of some aspects of the invention is that it provides an LED driving circuit capable of reducing the size of a circuit and of minutely adjusting an output voltage, an illuminating device, and an electro-optical device.

According to a first aspect of the invention, there is provided an LED driving circuit that drives a plurality of different LEDs. The LED driving circuit includes: a first power supply circuit that is supplied with an input voltage for generating a plurality of driving voltages and a reference voltage with respect to the input voltage and generates a first output voltage and a second output voltage from the input voltage, on the basis of a first control signal; and a second power supply circuit that is supplied with the first output voltage, the second output voltage, and the reference voltage, selects a voltage for driving the LEDs, on the basis of a second control signal, and outputs them.

According to the above-mentioned structure, the LED driving circuit is formed in a two-stage structure in which the first power supply circuit and the second power supply circuit are connected to each other. In this LED driving circuit, first, the first power supply circuit generates the first output voltage and the second output voltage from the input voltage and the reference voltage. Then, the second power supply circuit generates a voltage for driving LEDs from the first output voltage and the second output voltage. That is, the first power supply circuit has a circuit structure capable of generating two output voltages, and the second power supply circuit has a circuit structure capable of generating the voltage for driving the LEDs from the two output voltages generated by the first power supply circuit. Therefore, it is possible to reduce the sizes of the first power supply circuit and the second power supply circuit. In addition, it is possible to further decrease the number of ineffective circuits, resulting in a reduction in the overall size of a circuit, and to minutely adjust an LED driving voltage, as compared with a conventional structure in which a one-stage power supply circuit is used.

Further, in the LED driving circuit according to this aspect, preferably, the first power supply circuit includes: a booster unit that raises the input voltage with respect to the reference voltage to generate a plurality of voltages; and a voltage selecting unit that selects the first output voltage and the second output voltage from the reference voltage and the plurality of voltages supplied from the booster unit and outputs the selected voltages.

According to this structure, first, the booster unit raises the input voltage with respect to the reference voltage to generate a plurality of voltages. Then, the voltage selecting unit selects two of the generated voltages. In this way, it is possible to generate the first output voltage and the second output voltage to be higher than the input voltage. Therefore, this structure makes it possible to adjust the first output voltage and the second output voltage over a wide range.

Furthermore, in the LED driving circuit according to this aspect, preferably, the first power supply circuit includes: a voltage dividing unit that is composed of a resistor ladder circuit having a plurality of resistors connected in series to each other and divides a voltage into a plurality of voltages in the range of the input voltage and the reference voltage, the input voltage and the reference voltage being supplied to both ends of the resistor ladder circuit; and a voltage selecting unit that selects the first output voltage and the second output voltage from the reference voltage and the plurality of voltages supplied from the voltage dividing unit and outputs the selected voltages.

According to this structure, first, the voltage dividing unit divides a voltage into a plurality of voltages in the range from the reference voltage to the input voltage. Then, the voltage selecting unit selects two of the divided voltages. In this way, it is possible to generate the first output voltage and the second output voltage in the range of the two supplied voltages. Therefore, this structure makes it possible to minutely adjust the first output voltage and the second output voltage.

Moreover, in the LED driving circuit according to this aspect, preferably, the second power supply circuit includes: a voltage dividing unit that is composed of a resistor ladder circuit having a plurality of resistors connected in series to each other and divides a voltage into a plurality of voltages in the range of the first output voltage and the second output voltage, the first output voltage and the second output voltage being supplied to both ends of the resistor ladder circuit; and a voltage selecting unit that selects the voltage for dividing the LEDs from the plurality of voltages supplied from the voltage dividing unit, on the basis of the second control signal and outputs the selected voltage.

According to this structure, first, the voltage dividing unit divides a voltage into a plurality of voltages in the range from the first output voltage to the second output voltage. Next, the voltage selecting unit selects one of the plurality of voltages. In this way, the structure makes it possible to generate a voltage for driving LEDs in the range of the two supplied voltages and thus to minutely adjust the voltage for driving the LEDs.

According to another aspect of the invention, there is provided an LED driving circuit that drives a plurality of different LEDs. The LED driving circuit includes: a first power supply circuit that is supplied with an input voltage for generating a plurality of driving currents and a reference voltage with respect to the input voltage and generates a first output current from the input voltage, on the basis of a first control signal; and a second power supply circuit that is supplied with the first output current and the reference voltage and outputs a current for driving the LEDs, on the basis of a second control signal.

According to this structure, the LED driving circuit is formed in a two-stage structure in which the first power supply circuit and the second power supply circuit are connected to each other. In this LED driving circuit, first, the first power supply circuit generates the first output current from the input voltage and the reference voltage. Then, the second power supply circuit generates a voltage for driving LEDs from the first output current. That is, the first power supply circuit has a circuit structure capable of generating one output current, and the second power supply circuit has a circuit structure capable of generating a current for driving LEDs from the one output current generated by the first power supply circuit. Therefore, it is possible to reduce the sizes of the first power supply circuit and the second power supply circuit. In addition, it is possible to further decrease the number of ineffective circuits, resulting in a reduction in the overall size of a circuit, and to minutely adjust an LED driving current, as compared with a conventional structure in which a one-stage power supply circuit is used.

Further, in the LED driving circuit according to this aspect, preferably, the first power supply circuit includes: a current amplifying unit that is composed of a current mirror circuit having a plurality of transistors whose gates are connected to each other, the input voltage being supplied to the current mirror circuit; and a current control unit that controls currents output from the current amplifying unit by using a plurality of transistors and outputs the sum of the controlled currents as a first output current.

According to this structure, first, the current amplifying unit generates a plurality of currents according to a current corresponding to an input voltage. Then, the current control unit controls the generated currents and outputs the sum of the controlled currents as a first output current. In this way, it is possible to generate a first output current that is n times (n is an integer) larger than the current corresponding to the input voltage, which makes it possible to adjust the first output current over a wide range.

Furthermore, in the LED driving circuit according to this aspect, preferably, the second power supply circuit includes a pulse width modulating circuit that has a switching element, and modulates the pulse width of the first output current, on the basis of square waves which is supplied to the switching element as the second control signal, to output the current for driving the LEDs.

According to this structure, the pulse width modulating circuit modulates the pulse width of the first output current. In this way, it is possible to set an output current to be smaller than the first output current and to output it as a driving current, which makes it possible to minutely adjust the driving current.

According to still another aspect of the invention, an illuminating device includes the above-mentioned LED driving circuit.

According to yet another aspect of the invention, an electro-optical device includes the illuminating device. Therefore, the illuminating device and the electro-optical device can have a small size and a high display quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
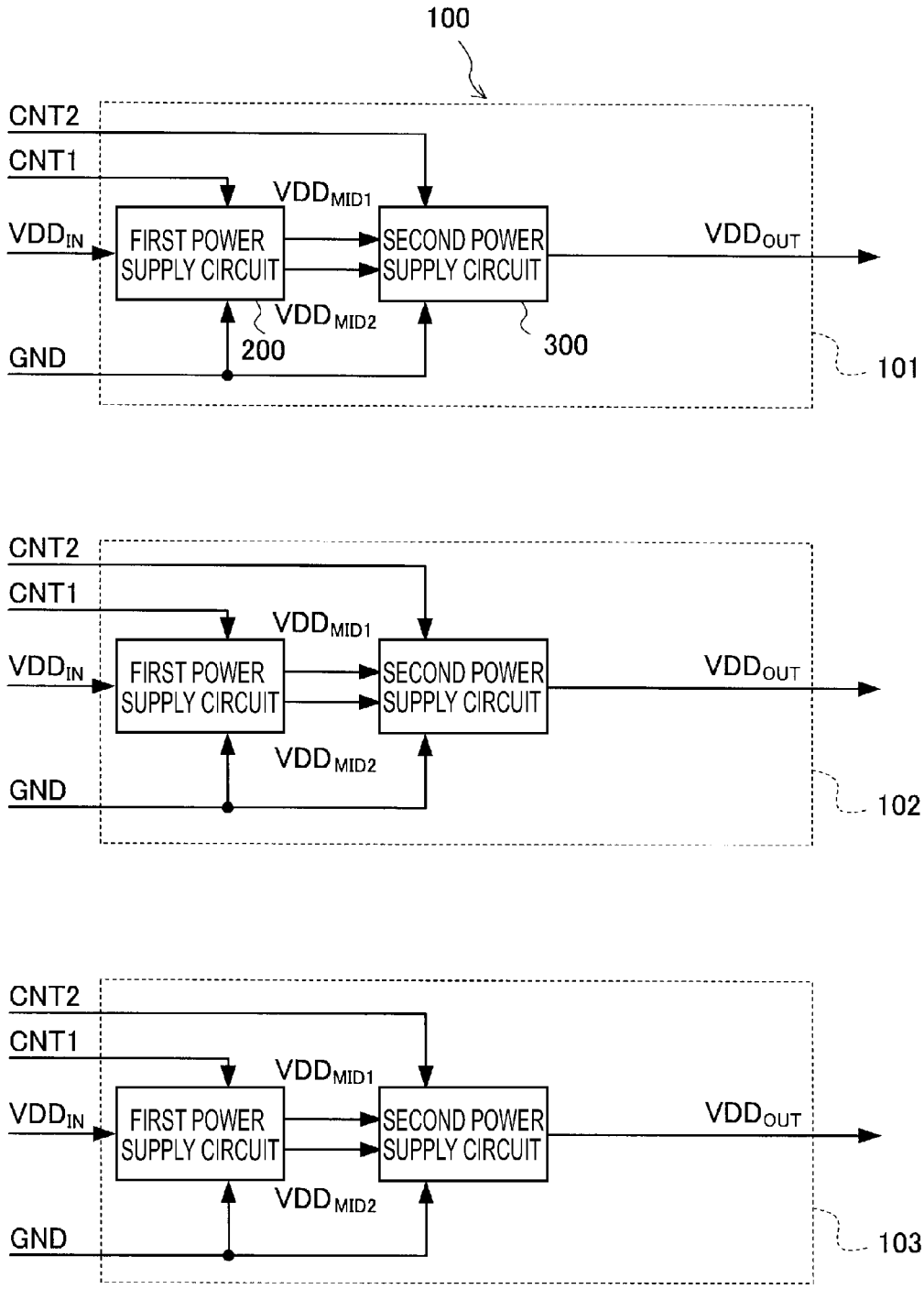
FIG. 1 is a block diagram illustrating an LED driving circuit according to a first embodiment of the invention.

FIG. 1 is a block diagram illustrating an LED driving circuit 100 according to a first embodiment of the invention. The LED driving circuit 100 includes a plurality of LED driving unit circuits for driving LEDs each having a single light emission peak wavelength. In this embodiment, the LED driving circuit 100 includes LED driving unit circuits 101, 102, and 103 for respectively driving LEDs having red, green, and blue emission peak wavelengths. In addition, the LED driving unit circuits 101, 102, and 103 supply a driving voltage to the corresponding LEDs.

The LED driving unit circuit 101 includes a first power supply circuit 200 which generates a first output voltage $VDD_{MID1}$ and a second output voltage $VDD_{MID2}$ from an input voltage $VDD_{IN}$ and a reference voltage GND, on the basis of a first control signal CNT1, and a second power supply circuit 300 which generates an LED driving voltage $VDD_{OUT}$ from the first output voltage and the second output voltage, on the basis of a second control signal CNT2.

In this embodiment, the LED driving unit circuits 102 and 103 respectively drive the green and blue LEDs, and have the same structure as that of the LED driving unit circuit 101 for driving the red LED. Thus, a description thereof will be omitted.

Figure 2:
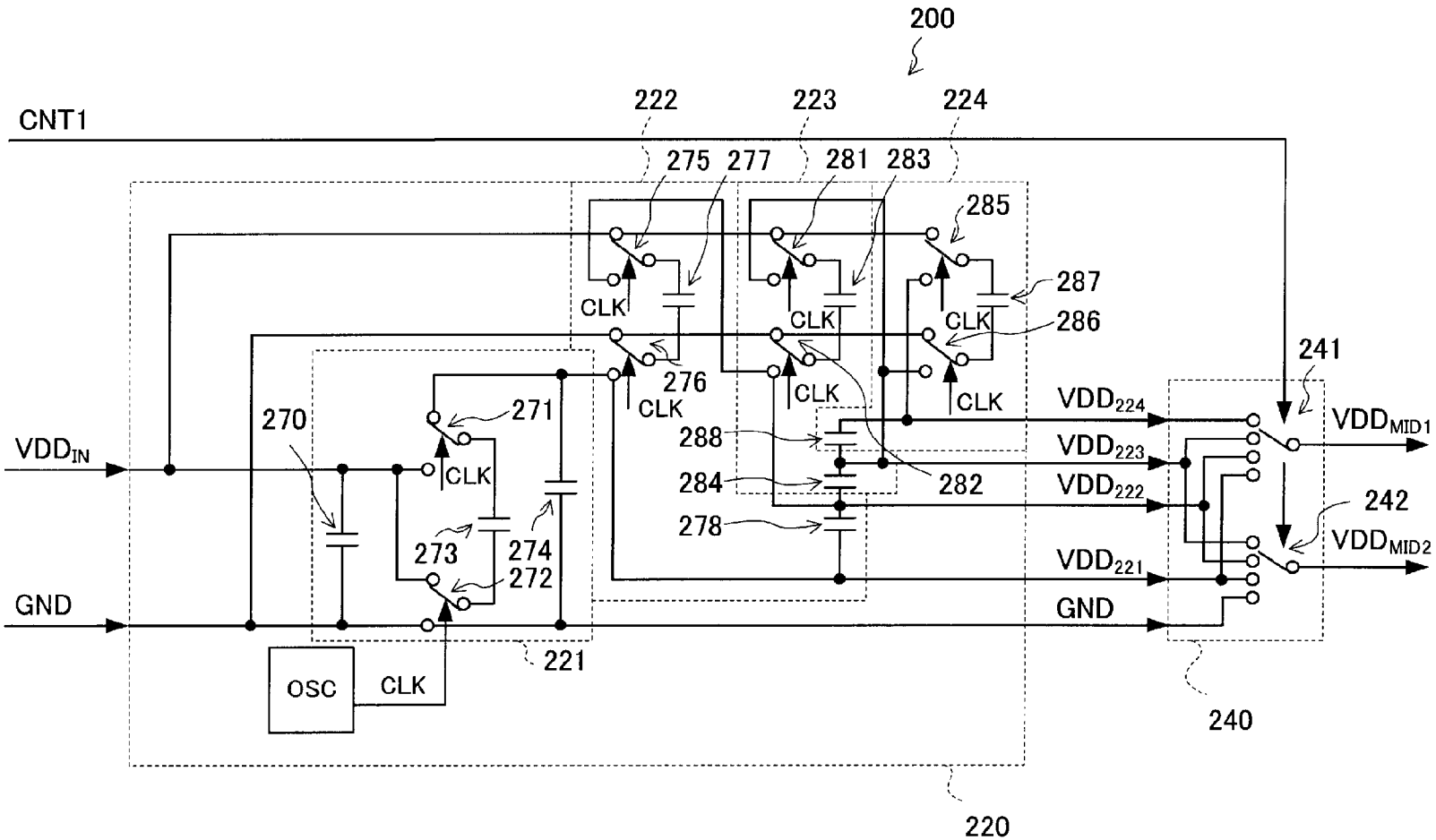
FIG. 2 is a block diagram illustrating a first power supply circuit according to the first embodiment of the invention.

FIG. 2 is a block diagram illustrating the first power supply circuit 200 according to the first embodiment of the invention.

The first power supply circuit 200 includes a booster unit that raises the input voltage $VDD_{IN}$ with respect to the reference voltage GND to generate voltages $VDD_{221}$, $VDD_{222}$, $VDD_{223}$, and $VDD_{224}$, a voltage selecting unit 240 which selects the first output voltage $VDD_{MID1}$ and the second output voltage $VDD_{MID2}$ from the raised voltages and the reference voltage, on the basis of the first control signal CNT1, and an oscillating circuit OSC which supplies a clock signal CLK to the booster unit 220.

The booster unit 220 functions to raise the input voltage $VDD_{IN}$ with respect to the reference voltage GND, and includes charge pump circuits 221, 222, 223, and 224.

The charge pump circuit 221 includes capacitors 270 and 274, switching elements 271 and 272 which are switched so as to be operatively associated with each other, and a capacitor 273 which connects these switching elements. This charge pump circuit raises the input voltage $VDD_{IN}$ to the voltage $VDD_{221}$ by two-stage operation. In the first stage, the input voltage $VDD_{IN}$ is supplied to one terminal of the capacitor 273 through the switching element 271, and the reference voltage GND is supplied to the other terminal thereof through the switching element 272. In this way, the input voltage $VDD_{IN}$ is charged into the capacitor 273. In the second stage, the switching elements 271 and 272 are switched in synchronization with the clock signal CLK, so that one terminal of the capacitor 274 is connected to one terminal of the capacitor 273 through the switching element 271 and the input voltage $VDD_{IN}$ is supplied to the other end of the capacitor 273 through the switching element 272. In this way, the sum of the input voltage $VDD_{IN}$ and the voltage $VDD_{IN}$ charged into the capacitor 273, that is, the voltage $VDD_{221}$ is generated. That is, the charge pump circuit 221 raises the input voltage $VDD_{IN}$ to the voltage $VDD_{221}$ that is substantially two times larger than the input voltage $VDD_{IN}$.

The charge pump circuit 222 includes a capacitor 278, switching elements 275 and 276 which are switched so as to be operatively associated with each other, and a capacitor 277 which connects these switching elements. This charge pump circuit raises the input voltage $VDD_{IN}$ to the voltage $VDD_{222}$ by two-stage operation. In the first stage, the input voltage $VDD_{IN}$ is supplied to one terminal of the capacitor 277 through the switching element 275, and the reference voltage GND is supplied to the other terminal thereof through the switching element 276. In this way, the input voltage $VDD_{IN}$ is charged into the capacitor 277. In the second stage, the switching elements 275 and 276 are switched in synchronization with the clock signal CLK, so that one terminal of the capacitor 278 is connected to one terminal of the capacitor 277 through the switching element 275 and the voltage $VDD_{221}$ is supplied to the other end of the capacitor 277 through the switching element 276. In this way, the sum of the voltage $VDD_{221}$ and the voltage $VDD_{IN}$ charged into the capacitor 277, that is, the voltage $VDD_{222}$ is generated. Since the voltage $VDD_{221}$ is substantially two times larger than the input voltage $VDD_{IN}$, the charge pump circuit 222 raises the input voltage $VDD_{IN}$ to the voltage $VDD_{222}$ that is substantially three times larger than the input voltage $VDD_{IN}$.

The charge pump circuit 223 includes a capacitor 284, switching elements 281 and 282 which are switched so as to be operatively associated with each other, and a capacitor 283 which connects these switching elements. The charge pump circuit 223 is operated in the same way as that in which the charge pump circuits 221 and 222 are operated, to raise the input voltage $VDD_{IN}$ to the voltage $VDD_{223}$ that is substantially four times larger than the input voltage $VDD_{IN}$.

The charge pump circuit 224 includes a capacitor 288, switching elements 285 and 286 which are switched so as to be operatively associated with each other, and a capacitor 287 which connects these switching elements. The charge pump circuit 224 is operated in the same way as that in which the charge pump circuits 221, 222, and 223 are operated, to raise the input voltage $VDD_{IN}$ to the voltage $VDD_{224}$ that is substantially five times larger than the input voltage $VDD_{IN}$.

The voltage selecting unit 240 includes switching elements 241 and 242 that select the first output voltage $VDD_{MID1}$ and the second output voltage $VDD_{MID2}$ from the raised voltages $VDD_{221}$ to $VDD_{224}$ and the reference voltage GND, on the basis of the first control signal CNT1.

The switching element 241 selects, as the first output voltage $VDD_{MID1}$, one of the raised voltages $VDD_{221}$, $VDD_{222}$, $VDD_{223}$, and $VDD_{224}$, on the basis of the first control signal.

The switching element 242 selects, as the second output voltage $VDD_{MID2}$, one of the reference voltage GND and the raised voltages $VDD_{221}$, $VDD_{222}$, and $VDD_{223}$, on the basis of the first control signal.

Next, the operation of the first power supply circuit 200 will be described below.

The booster unit 220 raises the input voltage $VDD_{IN}$ with respect to the reference voltage GND to generate the voltages $VDD_{221}$, $VDD_{222}$, $VDD_{223}$, and $VDD_{224}$ that are substantially two times, three times, four times, and five times larger than the input voltage, respectively.

The voltage selecting unit 240 selects the first output voltage $VDD_{MID1}$ and the second output voltage $VDD_{MID2}$ from the raised voltages and the reference voltage, on the basis of the first control signal CNT1.

That is, the first power supply circuit 200 raises the input voltage with respect to the reference voltage to generate a plurality of voltages, and selects the first output voltage and the second output voltage from the generated voltages and the reference voltage, on the basis of the first control signal.

The LED driving circuit 100 includes the first power supply circuit 200 according to the first embodiment of the invention, and thus has the following advantages. The first power supply circuit 200 can generate the first output voltage and the second output voltage to be higher than the input voltage, which makes it possible to adjust the first output voltage and the second output voltage over a wide range.

Figure 3:
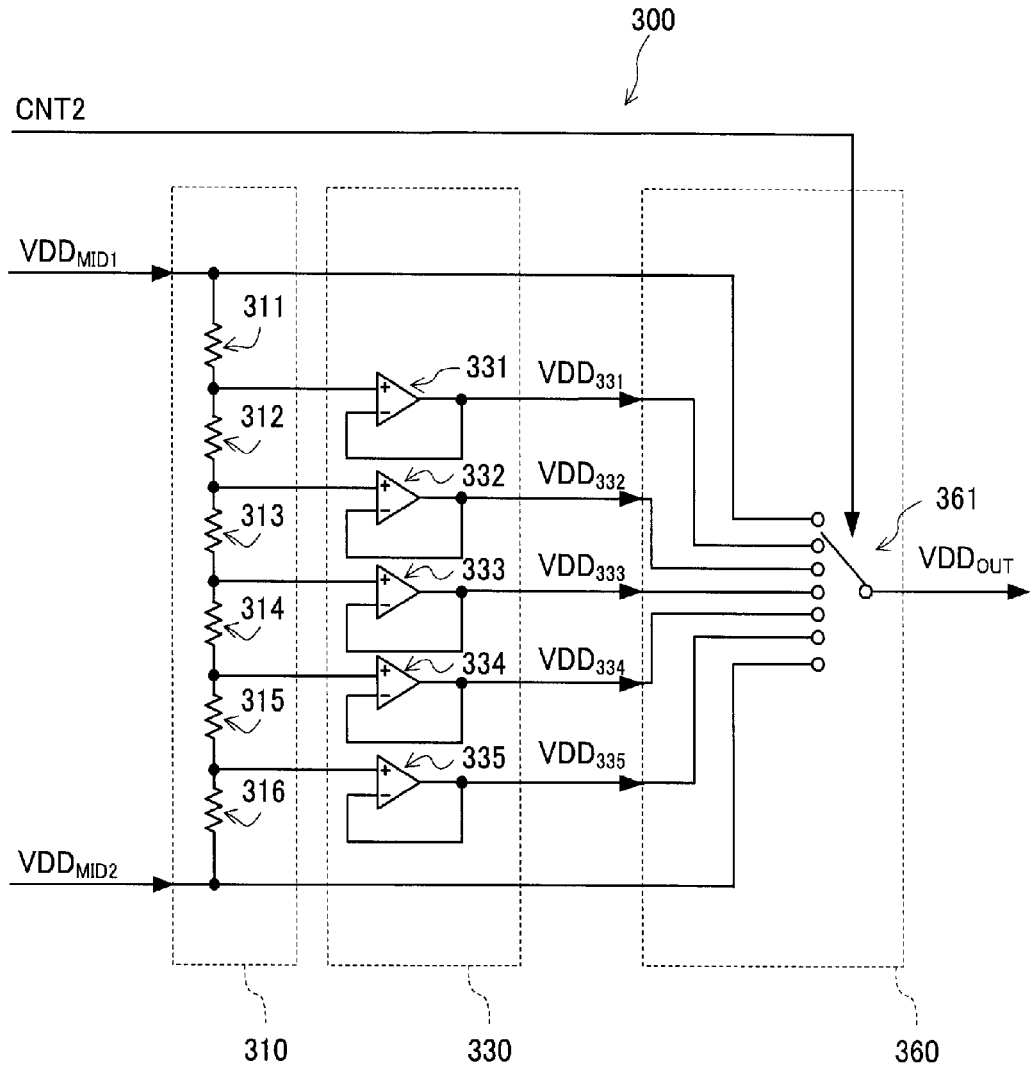
FIG. 3 is a block diagram illustrating a second power supply circuit according to the first embodiment of the invention.

FIG. 3 is a block diagram illustrating a second power supply circuit 300 according to the first embodiment of the invention.

The second power supply circuit 300 includes a voltage dividing unit 310 having a resistor ladder circuit in which resistors 311, 312, 313, 314, 315, and 316 are connected in series to each other, an impedance converting unit 330, and a voltage selecting unit 360. In the voltage dividing unit 310, the first output voltage $VDD_{MID1}$ and the second output voltage $VDD_{MID2}$ are supplied to both ends of the resistor ladder circuit, so that a plurality of voltages are generated within the range of the two voltages. The impedance converting unit 330 converts the impedance of the generated voltages to output a plurality of voltages $VDD_{331}$, $VDD_{332}$, $VDD_{333}$, $VDD_{334}$, and $VDD_{335}$. The voltage selecting unit 360 selects an LED driving voltage $VDD_{OUT}$ from the plurality of output voltages, the first output voltage, and the second output voltage, on the basis of the second control signal CNT2.

The voltage dividing unit 310 performs voltage division in the range from the first output voltage $VDD_{MID1}$ to the second output voltage $VDD_{MID2}$ by using the resistor ladder circuit.

A voltage is divided at an intersection point between the resistor 311 and the resistor 312 in the range from the first output voltage to the second output voltage, according to the ratio of the resistance value of the resistor 311 to the combined resistance value of the resistors 312, 313, 314, 315, and 316.

Further, voltages are divided at an intersection point between the resistor 312 and the resistor 313, an intersection point between the resistor 313 and the resistor 314, an intersection point between the resistor 314 and the resistor 315, and an intersection point between the resistor 315 and the resistor 316 in the same way as that in which the voltage is divided at the intersection point between the resistors 311 and 312, within the range from the first output voltage to the second output voltage, according to the resistance values.

The impedance converting unit 330 includes operational amplifiers 331, 332, 333, 334, and 335.

The operational amplifier 331 has an output terminal connected to an inverting input terminal thereof, and constitutes a voltage follower circuit. The voltage divided at the intersection point between the resistors 311 and 312 included in the resistor ladder circuit is supplied to a non-inverting input terminal of the operational amplifier 331. A voltage $VDD_{331}$ having impedance smaller than that of the supplied voltage is output from the output terminal of the operational amplifier 331.

Similar to the operational amplifier 331, each of the operational amplifiers 332, 333, 334, and 335 has an output terminal connected to an inverting input terminal thereof, and constitutes a voltage follower circuit. The voltages respectively divided at the intersection points between the resistors 312, 313, 314, 315, and 316 included in the resistor ladder circuit are supplied to non-inverting input terminals of the operational amplifiers 332, 333, 334, and 335. Voltages $VDD_{332}$, $VDD_{333}$, $VDD_{334}$, and $VDD_{335}$ having impedances smaller than those of the supplied voltages are output from the output terminals of amplifiers 332, 333, 334, and 335, respectively.

Further, the first output voltage $VDD_{MID1}$ and the second output voltage $VDD_{MID2}$ are supplied to the operational amplifiers as operational amplifier driving voltages. Therefore, power consumption can be reduced.

The voltage selecting unit 360 includes a switching element 361 which selects the LED driving voltage $VDD_{OUT}$ from the impedance converted voltages $VDD_{331}$, $VDD_{332}$, $VDD_{333}$, $VDD_{334}$, and $VDD_{335}$, the first output voltage $VDD_{MID1}$, and the second output voltage $VDD_{MID2}$, on the basis of the second control signal CNT2.

Next, the operation of the second power supply circuit 300 will be described below.

The voltage dividing unit 310 divides a voltage within the range from the first output voltage $VDD_{MID1}$ to the second output voltage $VDD_{MID2}$.

The impedance converting unit 330 lowers the impedance values of a plurality of divided voltages and outputs the voltages $VDD_{331}$, $VDD_{332}$, $VDD_{333}$, $VDD_{334}$, and $VDD_{335}$.

The voltage selecting unit 360 selects the LED driving voltage $VDD_{OUT}$ from the impedance converted voltages, the first output voltage, and the second output voltage.

That is, the second power supply circuit 300 divides a voltage within the range from the first output voltage to the second output voltage to generate a plurality of voltages, and selects the LED driving voltage $VDD_{OUT}$ from the generated voltages, on the basis of the second control signal.

The LED driving circuit 100 includes the second power supply circuit 300 according to this embodiment of the invention, and thus has the following advantages. The second power supply circuit 300 can generate the LED driving voltage within the range of the two voltages, which makes it possible to minutely adjust the LED driving voltage.

This embodiment has the following advantages. The first power supply circuit 200 generates a voltage higher than the input voltage, and the second power supply circuit 300 divides the generated voltage to generate the LED driving voltage. Therefore, this structure makes it possible to minutely adjust the LED driving voltage over a wide range. In addition, this structure makes it possible to further decrease the number of ineffective circuits and thus to reduce the overall size of a circuit, as compared with the conventional structure in which a one-stage power supply circuit is used.

Next, the size of the LED driving circuit 100 will be described below.

Figure 4:
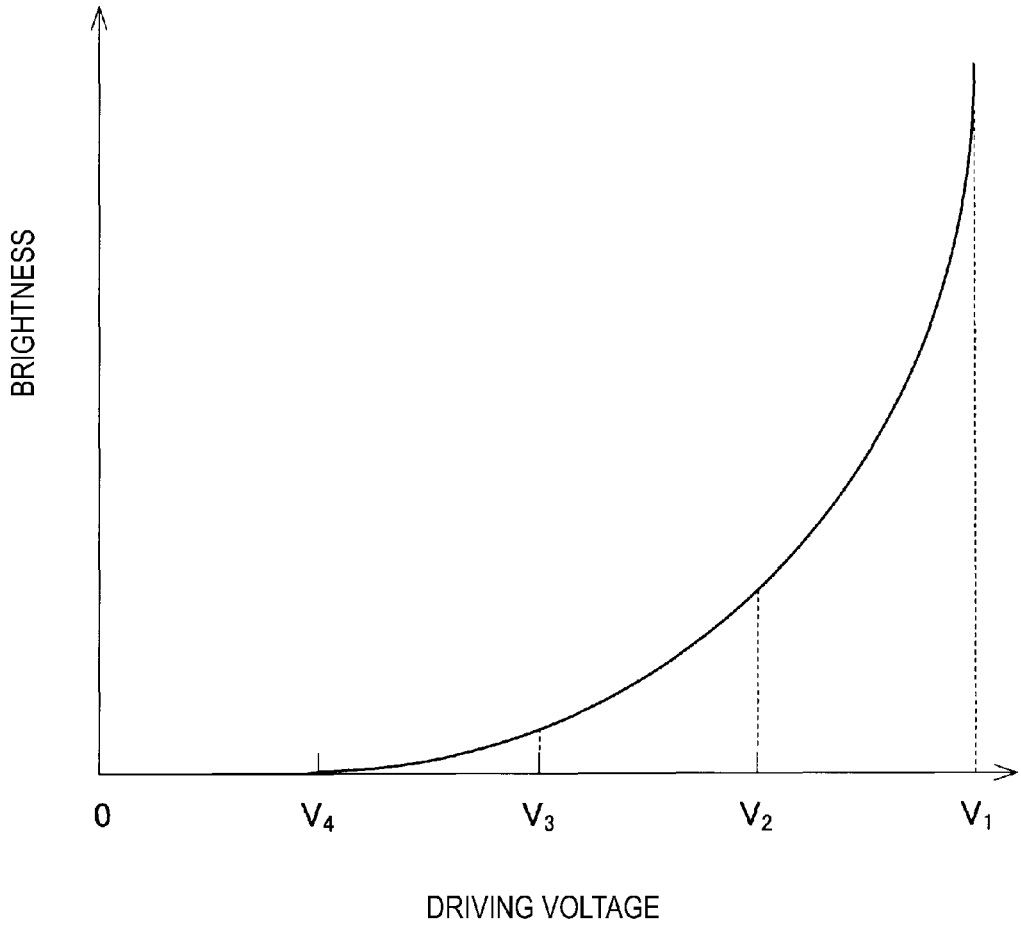
FIG. 4 is a graph illustrating the relationship between a driving voltage and brightness of an LED for a backlight.

FIG. 4 is a graph illustrating the relationship between an LED driving voltage and brightness. FIG. 4 also shows the relationship between an LED driving current and brightness. In FIG. 4, for example, the following LED driving circuit is assumed: LED driving voltages V1, V2, V3, and V4 are 1 V, 2 V, 3 V, and 4 V, respectively; an input voltage $VDD_{IN}$ in the range of 0 V to 4 V is supplied; a reference voltage GND of 0 V is supplied; and a voltage that is adjusted at voltage intervals of 100 mV in the range of 0 V to 4 V is output to an LED as an LED driving voltage VX.

First, it is considered that the LED driving circuit includes only a power supply circuit that has a resistor ladder circuit as in the related art, that is, the power supply circuit is formed in a one-stage structure. In this case, an LED driving voltage lower than the input voltage is generated. Therefore, the input voltage $VDD_{IN}$ should be equal to or higher than 4 V. For example, when an input voltage of 4 V is supplied, forty resistors are needed to adjust the LED driving voltage at voltage intervals of 100 mV in the range of 0 V to 4 V.

Meanwhile, it is considered that the LED driving circuit includes the first power supply circuit provided with the charge pump circuits and the second power supply circuit provided with the resistor ladder circuit as in this embodiment of the invention, that is, the power supply circuit is formed in a two-stage structure. In this case, since the LED driving circuit has the charge pump circuits, the input voltage $VDD_{IN}$ may be lower than the LED driving voltage VX. The first power supply circuit raises the input voltage to generate two voltages higher and lower than the LED driving voltage. Then, the second power supply circuit divides these two voltages at voltage intervals of 100 mV and outputs the divided voltages as the LED driving voltages. For example, an input voltage of 1 V is supplied, and a voltage of 3.5 V is output as the LED driving voltage VX. In this case, the first power supply circuit generates two voltages 3 V and 4 V. The second power supply circuit divides the voltages at voltage intervals of 100 mV and outputs as an LED driving voltage of 3.5 V. Therefore, ten resistors are needed. In this way, the first power supply circuit may generate two voltages with the LED driving voltage interposed therebetween, that is, a pair of voltages 0 V and 1 V, 1 V and 2 V, 2 V and 3 V, or 3 V and 4 V, and the second power supply circuit may divide the voltages at voltage intervals of 100 mV in the range of two voltages and output the divided voltages as the LED driving voltages. Therefore, the driving voltage is adjusted at voltage intervals of 100 mV in the range of 0 V to 4 V, and thus ten resistors are enough for this structure.

Since the LED driving circuit has a two-stage structure of the first power supply circuit and the second power supply circuit and these power supply circuits are sequentially connected to each other, it is possible to reduce the size of the LED driving circuit and to minutely adjust a driving voltage. In addition, this structure makes it possible to lower the input voltage and thus to reduce power consumption.

Further, it is preferable to independently set the resistance values of the resistors 311, 312, 313, 314, 315, and 316 constituting the resistor ladder circuit in order to adjust the LED driving voltage such that a uniform variation in brightness is obtained from the relationship between the LED driving voltage and the brightness.

That is, as shown in FIG. 4, the relationship between the LED driving voltage and the brightness has a non-linear characteristic. In order to adjust the brightness to be uniform, it is possible to independently set the resistance values of the resistors included in the resistor ladder circuit and to non-linearly adjust the LED driving voltage.

Second Embodiment

A second embodiment of the invention differs from the first embodiment in the structure of an LED driving unit circuit including a first power supply circuit and a second power supply circuit. The structure of the first power supply circuit and the second power supply circuit will be described below. In this embodiment, the other structures are the same as those in the first embodiment, and thus a description thereof will be omitted for simplicity.

Figure 5:
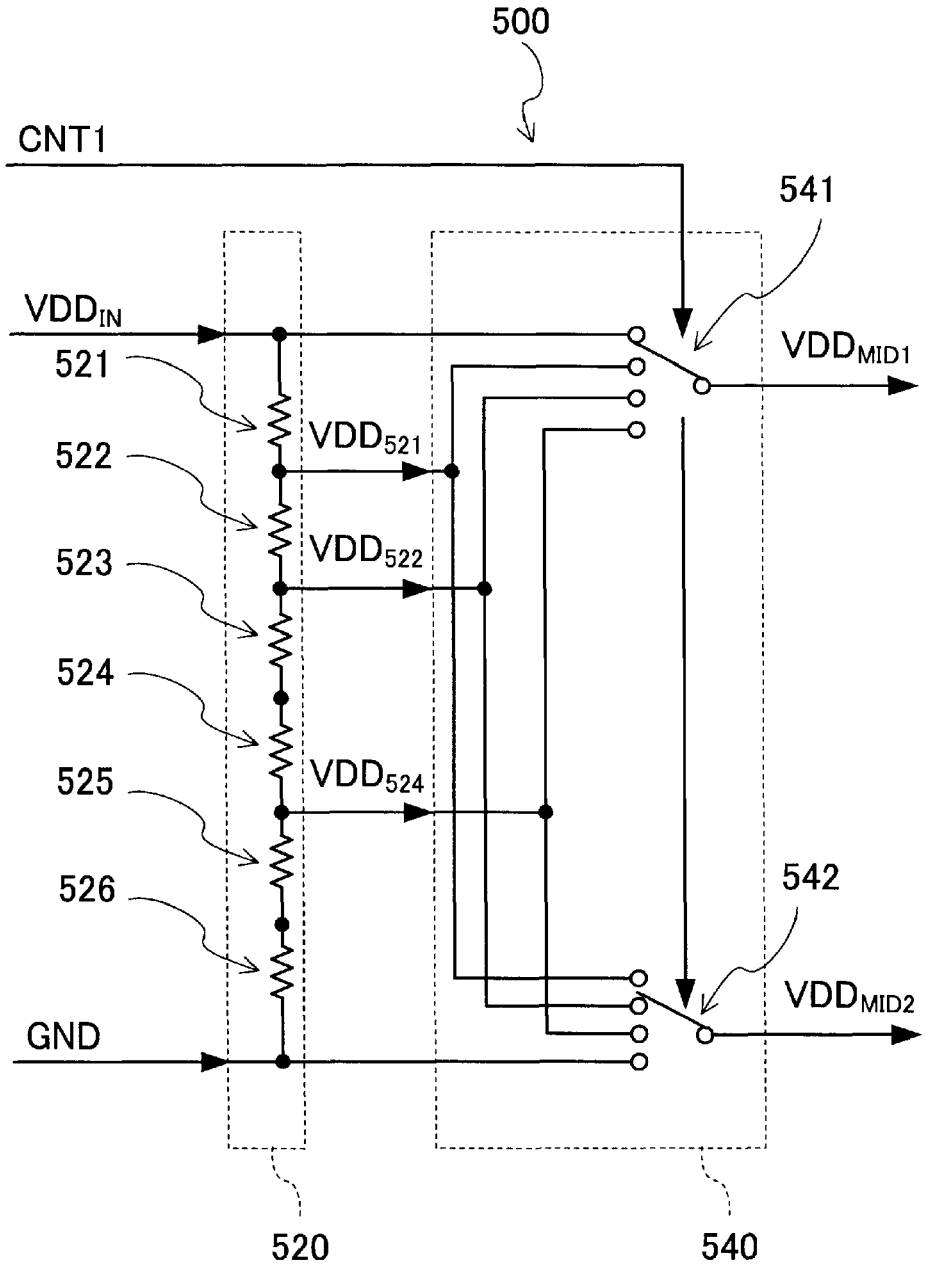
FIG. 5 is a block diagram illustrating a first power supply circuit according to a second embodiment of the invention.

FIG. 5 is a block diagram illustrating a first power supply circuit 500 according to the second embodiment of the invention.

The first power supply circuit 500 includes a voltage dividing unit 520 having a resistor ladder circuit in which resistors 521, 522, 523, 524, 525, and 526 are connected in series to each other and a voltage selecting unit 540. In the voltage dividing unit 520, an input voltage $VDD_{IN}$ and a reference voltage GND are supplied to both ends of the resistor ladder circuit, and voltages are divided in the range from the reference voltage to the input voltage, so that voltages $VDD_{521}$, $VDD_{522}$, and $VDD_{524}$ are generated. The voltage selecting unit 540 selects a first output voltage $VDD_{MID1}$ and a second output voltage $VDD_{MID2}$ from the divided voltages and the reference voltage, on the basis of a first control signal CNT1.

The voltage dividing unit 520 performs voltage division in the range from the reference voltage GND to the input voltage $VDD_{IN}$ by using the resistor ladder circuit.

A voltage is divided at an intersection point between the resistor 521 and the resistor 522 in the range from the reference voltage to the input voltage, according to the ratio of the resistance value of the resistor 521 to the combined resistance value of the resistors 522, 523, 524, 525, and 526, and is output as a voltage $VDD_{521}$.

Further, voltages are divided at an intersection point between the resistor 522 and the resistor 523 and an intersection point between the resistor 524 and the resistor 525 in the same way as that in which the voltage is divided at the intersection point between the resistor 521 and the resistor 522, within the range from the reference voltage to the input voltage, according to the resistance values, and are output as voltages $VDD_{522}$ and $VDD_{524}$.

The voltage selecting unit 540 includes switching elements 541 and 542 that select the first output voltage $VDD_{MID1}$ and the second output voltage $VDD_{MID2}$ from the divided voltages $VDD_{521}$, $VDD_{522}$, and $VDD_{524}$, the input voltage $VDD_{IN}$, and the reference voltage GND, on the basis of the first control signal CNT1.

The switching element 541 selects, as the first output voltage $VDD_{MID1}$, one of the divided voltages and the input voltage, on the basis of the first control signal.

The switching element 542 selects, as the second output voltage $VDD_{MID2}$, one of the reference voltage and the divided voltages, on the basis of the first control signal.

Next, the operation of the first power supply circuit 500 will be described below.

The voltage dividing unit 520 divides a voltage in the range from the reference voltage GND to the input voltage $VDD_{IN}$ to generate the voltages $VDD_{521}$, $VDD_{522}$, and $VDD_{524}$.

The voltage selecting unit 540 selects the first output voltage $VDD_{MID1}$ and the second output voltage $VDD_{MID2}$ from the divided voltages, the input voltage, and the reference voltage, on the basis of the first control signal CNT1.

That is, the first power supply circuit 500 divides a voltage in the range from the reference voltage to the input voltage to generate a plurality of voltages, and selects the first output voltage and the second output voltage from the divided voltages, the input voltage, and the reference voltage, on the basis of the first control signal.

An LED driving circuit 110 includes the first power supply circuit 500 according to the second embodiment of the invention, and thus has the following advantages. The first power supply circuit 500 can generate the first output voltage and the second output voltage in the range from the reference voltage to the input voltage, which makes it possible to minutely adjust an output voltage.

Further, in this embodiment, a voltage is divided into three types of voltages $VDD_{521}$, $VDD_{522}$, and $VDD_{524}$ by the resistor ladder circuit, and the three voltages $VDD_{521}$, $VDD_{522}$, and $VDD_{524}$ are supplied to the voltage selecting unit 540. However, the invention is not limited thereto. For example, the resistor ladder circuit may divide a voltage into four or more types of voltages and then output them, in order to minutely adjust the voltage.

Figure 6:
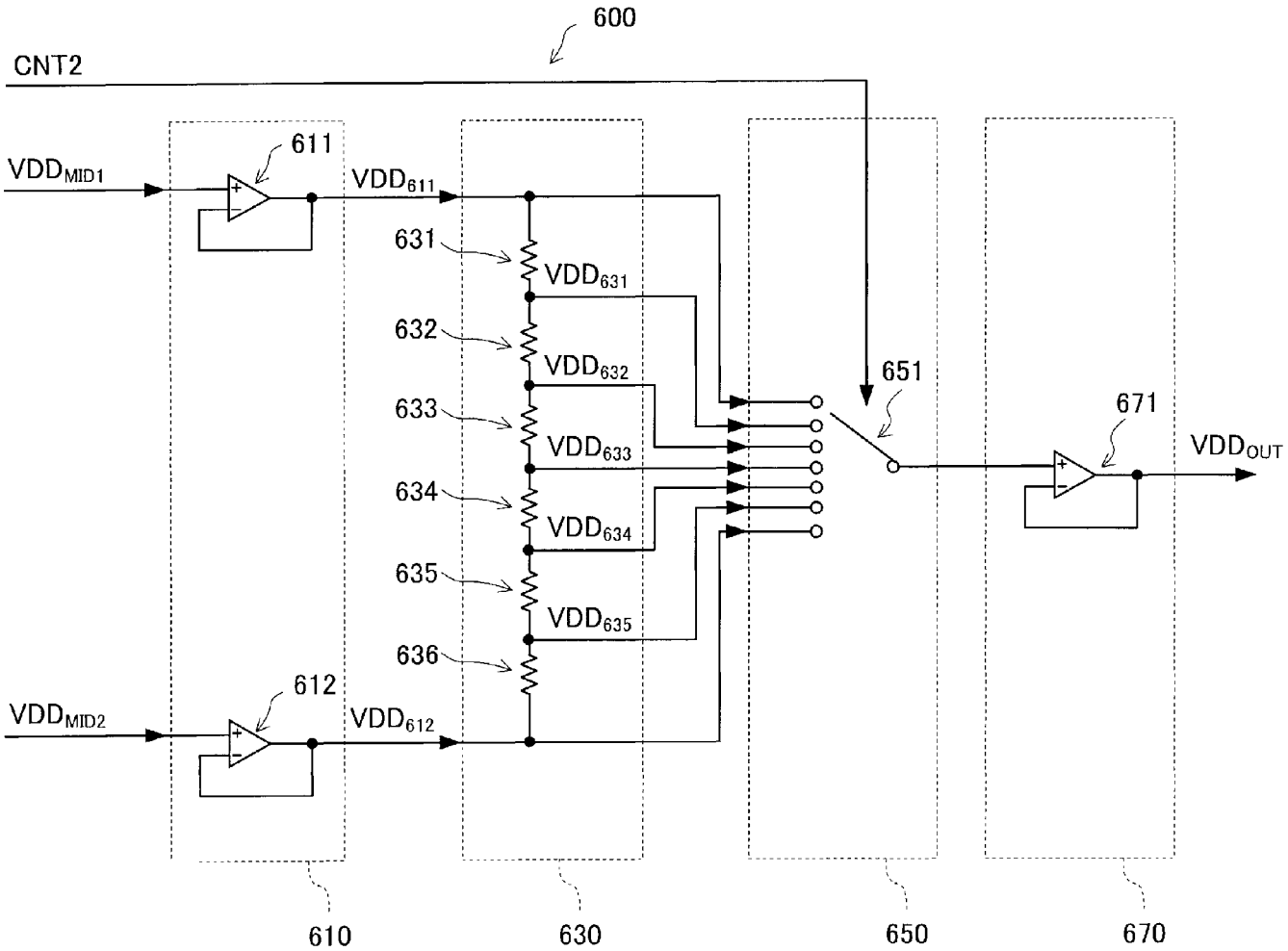
FIG. 6 is a block diagram illustrating a second power supply circuit according to the second embodiment of the invention.

FIG. 6 is a block diagram illustrating a second power supply circuit 600 according to the second embodiment of the invention.

The second power supply circuit 600 includes a first impedance converting unit 610, a voltage dividing unit 630 having a resistor ladder circuit in which resistors 631, 632, 633, 634, 635, and 636 are connected in series to each other, a voltage selecting unit 650, and a second impedance converting unit 670. The first impedance converting unit 610 converts the impedance of the first output voltage $VDD_{MID1}$ and the second output voltage $VDD_{MID2}$ to output voltages $VDD_{611}$ and $VDD_{612}$. In the voltage dividing unit 630, the two impedance converted voltages are supplied to both ends of the resistor ladder circuit, and the voltage formed between both ends are divided into a plurality of voltages in the range of the two voltages, so that voltages $VDD_{631}$, $VDD_{632}$, $VDD_{633}$, $VDD_{634}$, and $VDD_{631}$ are generated. The voltage selecting unit 650 selects one of the divided voltages and the two impedance converted voltages. The second impedance converting unit 670 converts the impedance of the selected voltage and outputs it as an LED driving voltage $VDD_{OUT}$.

Further, the first impedance converting unit 610 includes operational amplifiers 611 and 612.

The operational amplifier 611 has an output terminal connected to an inverting input terminal thereof, and constitutes a voltage follower circuit. The first output voltage $VDD_{MID1}$ is supplied to a non-inverting input terminal of the operational amplifier 611. A voltage $VDD_{611}$ having impedance smaller than that of the supplied voltage is output from the output terminal of the operational amplifier 611.

Similar to the operational amplifier 611, the operational amplifier 612 has an output terminal connected to an inverting input terminal thereof, and constitutes a voltage follower circuit. The second output voltage $VDD_{MID2}$ is supplied to a non-inverting input terminal of the operational amplifier 612. A voltage $VDD_{612}$ having impedance smaller than that of the supplied voltage is output from the output terminal of the operational amplifier 612.

Further, the first output voltage $VDD_{MID1}$ and the second output voltage $VDD_{MID2}$ are supplied to the operational amplifiers as operational amplifier driving voltages. Therefore, power consumption can be reduced.

The voltage dividing unit 630 performs voltage division in the range from the voltage $VDD_{611}$ to the voltage $VDD_{612}$ by using the resistor ladder circuit.

A voltage is divided at an intersection point between the resistor 631 and the resistor 632 in the range from the impedance converted voltage $VDD_{611}$ to the impedance converted voltage $VDD_{612}$, according to the ratio of the resistance value of the resistor 631 to the combined resistance value of the resistors 632, 633, 634, 635, and 636.

Further, voltages are divided at an intersection point between the resistor 632 and the resistor 633, an intersection point between the resistor 633 and the resistor 364, an intersection point between the resistor 634 and the resistor 635, and an intersection point between the resistor 635 and the resistor 636 in the same way as that in which the voltage is divided at the intersection point between the resistors 631 and 632, within the range from voltage $VDD_{611}$ to the voltage $VDD_{612}$, according to the resistance values.

The voltage selecting unit 650 includes a switching element 651 which selects one of the divided voltages $VDD_{631}$, $VDD_{632}$, $VDD_{633}$, $VDD_{634}$, and $VDD_{635}$, the first output voltage $VDD_{MID1}$, and the second output voltage $VDD_{MID2}$, on the basis of the second control signal CNT2.

The second impedance converting unit 670 includes a rail-to-rail operational amplifier 671 in which the range of an output voltage is substantially equal to the range of a driving voltage.

The operational amplifier 671 has an output terminal connected to an inverting input terminal thereof, and constitutes a voltage follower circuit. The selected voltage is supplied to a non-inverting input terminal of the operational amplifier 671. An LED driving voltage $VDD_{OUT}$ having smaller impedance than that of the supplied voltage is output from the output terminal of the operational amplifier 671.

Further, the voltage $VDD_{611}$ and the voltage $VDD_{612}$ are supplied to the operational amplifiers as operational amplifier driving voltages. Therefore, power consumption can be reduced.

Next, the operation of the second power supply circuit 600 will be described below.

The first impedance converting unit 610 reduces the impedances of the first output voltage $VDD_{MID1}$ and the second output voltage $VDD_{MID2}$ to output the voltages $VDD_{611}$ and $VDD_{612}$.

The voltage dividing circuit 630 performs voltage division in the range of the two impedance converted voltages to generate the voltages $VDD_{631}$, $VDD_{632}$, $VDD_{633}$, $VDD_{634}$, and $VDD_{635}$.

The voltage selecting unit 650 selects one of the divided voltages, the first output voltage, and the second voltage.

The second impedance converting unit 670 reduces the impedances of the selected voltage and outputs it as the LED driving voltage $VDD_{OUT}$.

That is, the second power supply circuit 600 divides a voltage into a plurality of voltages in the range from the first output voltage to the second output voltage, selects one of the divided voltages, on the basis of the second control signal, and outputs the selected voltage as the LED driving voltage $VDD_{OUT}$.

The LED driving circuit 110 includes the second power supply circuit 600 according to the second embodiment of the invention, and thus has the following advantages. The second power supply circuit 600 can generate an output voltage within the range of two supplied voltages, and output it as an LED driving voltage, which makes it possible to minutely adjust the LED driving voltage.

This embodiment has the following advantages. The first power supply circuit 500 divides an input voltage into a plurality of voltages, and the second power supply circuit 600 further divides the divided voltages to generate an LED driving voltage. Therefore, this structure makes it possible to minutely adjust the LED driving voltage. In addition, this structure makes it possible to further decrease the number of ineffective circuits and thus to reduce the overall size of a circuit, as compared with the conventional structure in which a one-stage power supply circuit is used.

Third Embodiment

A third embodiment of the invention differs from the first embodiment in the structure of an LED driving unit circuit including a first power supply circuit and a second power supply circuit and a connection between the first power supply circuit and the second power supply circuit. First, a description will be made of the connection between the first power supply circuit and the second power supply circuit, and then the structure of the first power supply circuit and the second power supply circuit will be described. In this embodiment, the other structures are the same as those in the first embodiment, and thus a description thereof will be omitted for simplicity.

Figure 7:
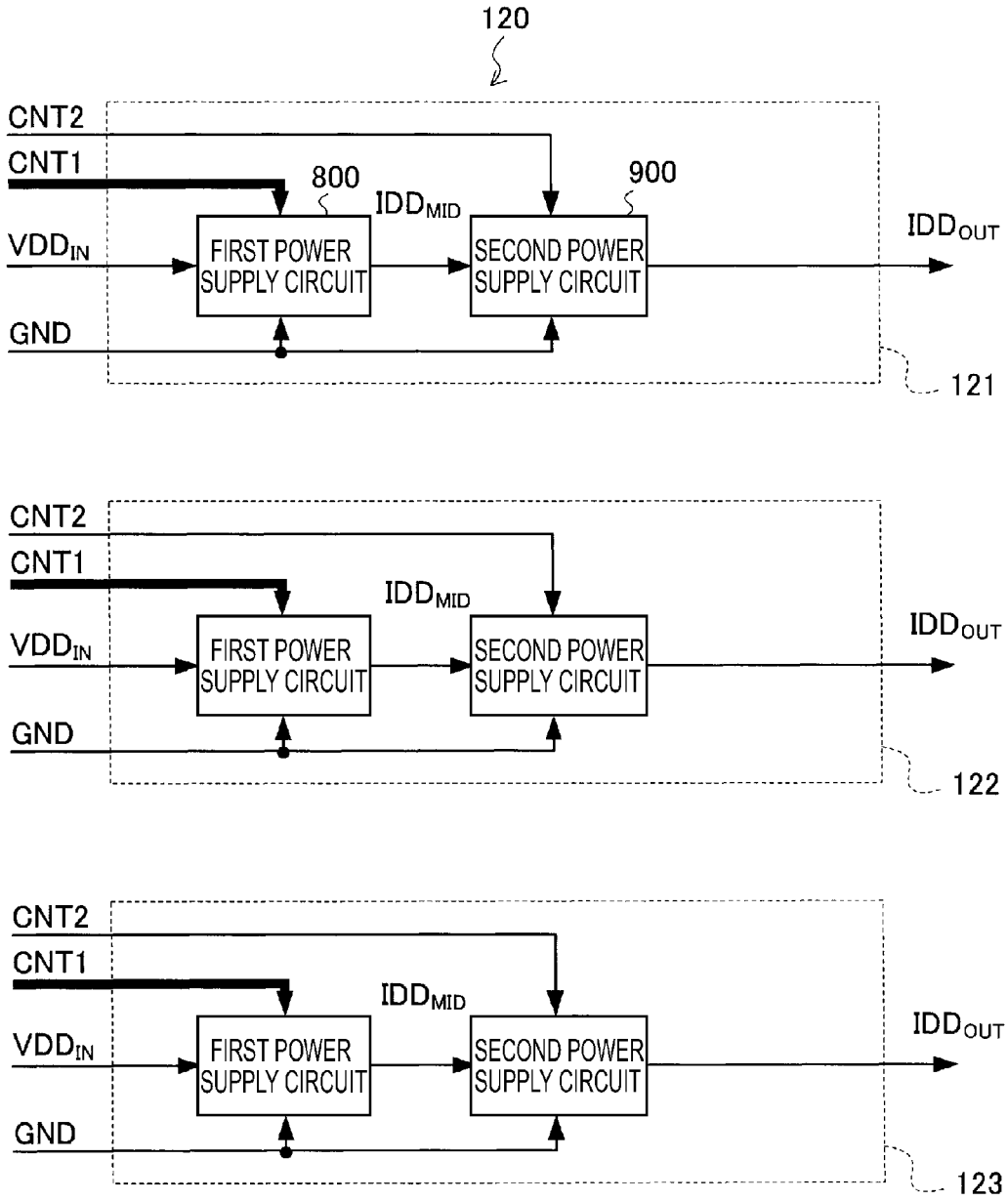
FIG. 7 is a block diagram illustrating an LED driving circuit according to a third embodiment of the invention.

FIG. 7 is a block diagram illustrating an LED driving circuit 120 according to the third embodiment of the invention. A current $IDD_{MID}$ is output from a first power supply circuit 800 to a second power supply circuit 900. In addition, a first control signal CNT1 is a four-bit signal including four control signals CNT1A, CNT1B, CNT1C, and CNT1D.

Next, the first power supply circuit 800 and the second power supply circuit 900 will be described below.

Figure 8:
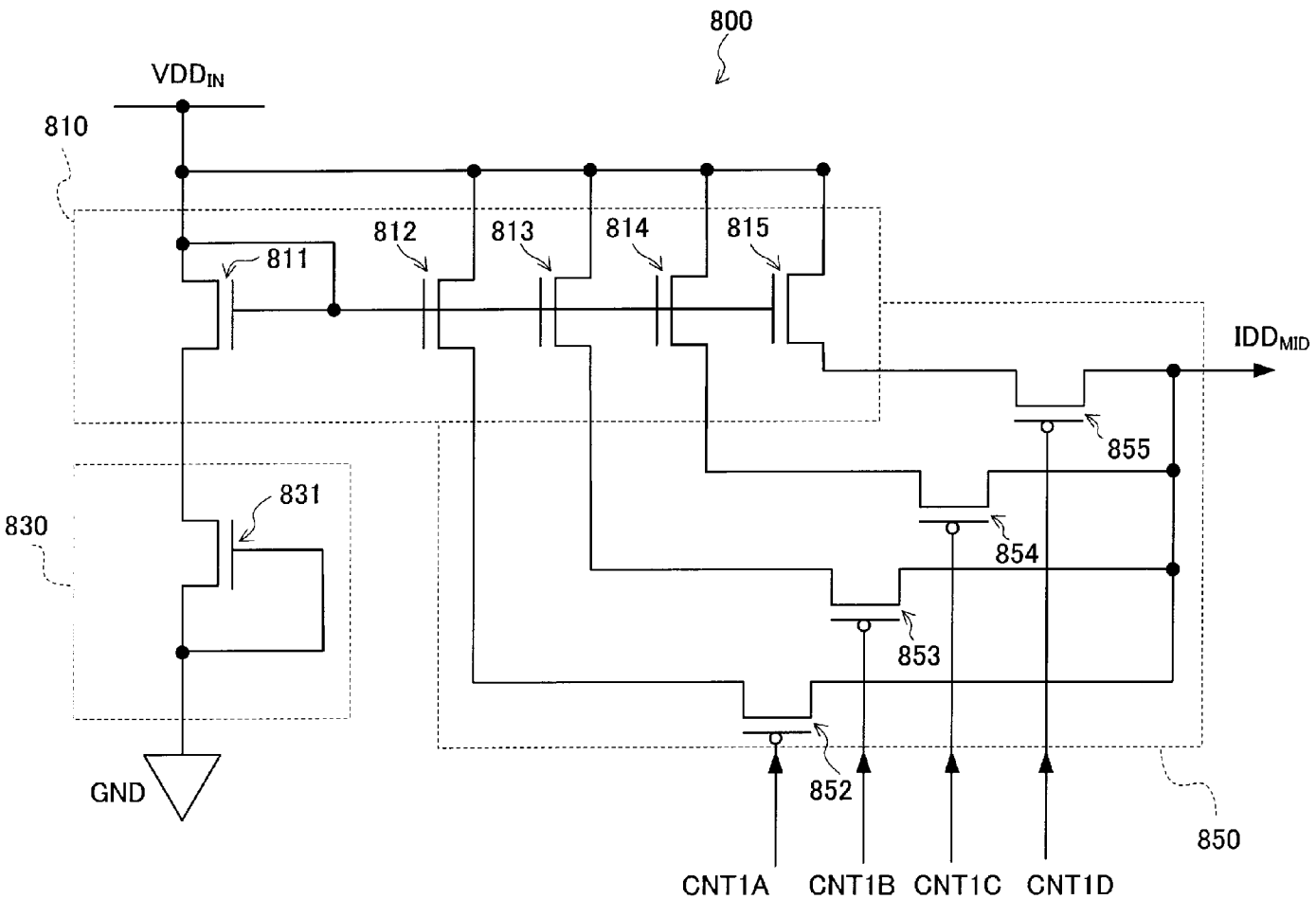
FIG. 8 is a block diagram illustrating a first power supply circuit according to the third embodiment of the invention.

FIG. 8 is a block diagram illustrating the first power supply circuit 800 according to the third embodiment.

The first power supply circuit 800 includes a current amplifying unit 810, a constant current circuit unit 830 which is connected to the current amplifying unit 810, and a current control unit 850. The current amplifying unit 800 has a current mirror circuit in which a gate of a transistor 811 is connected to gates of transistors 812, 813, 814, and 815, and generates a plurality of currents, according to a current corresponding to an input voltage. The current control unit 850 includes transistors 852, 853, 854, and 855. In addition, the current control unit 850 controls the generated currents on the basis of the first control signal CNT1, and outputs the sum of the controlled currents as a first output current $IDD_{MID}$.

The current amplifying unit 810 generates a plurality of currents according to a current flowing through the transistor 811 by using the current mirror circuit.

A current corresponding to an input voltage $VDD_{IN}$ flows through the transistor 811. This current causes currents having magnitudes corresponding to transistor ratios to flow through the transistors 812, 813, 814, and 815.

The constant current circuit unit 830 includes a transistor 831. A source of the transistor 831 is connected to a drain of the transistor 811, which forms a constant current circuit. The transistor 831 makes a constant current flow through the transistor 811.

The current control unit 850 includes the transistors 852, 853, 854, and 855.

The transistor 852 controls the flow of a current passing through the transistor 812, on the basis of the control signal CNT1A. For example, in a case in which the transistor 852 is of a p-channel type, the transistor 852 is turned on when the control signal CNT1A having a low level is supplied. In this case, a current flows through not only the transistor 812 but also the transistor 852.

Similar to the transistor 852, the transistors 853, 854, and 855 control the flow of currents passing through the transistors 813, 814, and 815, on the basis of the control signals CNT1B, CNT1C, and CNT1D, respectively.

The sum of the currents controlled by the transistors 852, 853, 854, and 855 is output as the first output current $IDD_{MID}$.

Next, the operation of the first power supply circuit 800 will be described below.

The current amplifying unit 810 generates a plurality of currents according to a current corresponding to the input voltage $VDD_{IN}$.

The constant current circuit unit 830 makes the generated currents constant.

The current control unit 850 controls the flow of the constant currents and outputs the sum of the controlled currents as the first output current $IDD_{MID}$.

That is, the first power supply circuit 800 outputs, as the first output current, a current that is substantially n times (n is an integer) larger than the current flowing through the transistor 811.

The LED driving circuit 120 includes the first power supply circuit 800 according to the third embodiment of the invention, and thus has the following advantages. The first power supply circuit 800 can generate, as the first output current, a current that is substantially n times (n is an integer) larger than the current corresponding to an input voltage, which makes it possible to adjust the output current over a wide range.

Figure 9:
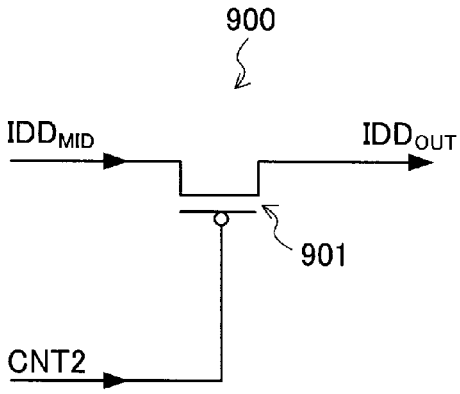
FIG. 9 is a block diagram illustrating a second power supply circuit according to the third embodiment of the invention.

FIG. 9 is a block diagram illustrating a second power supply circuit 900 according to the third embodiment of the invention.

The second power supply circuit 900 includes a switching element 901 that modulates the pulse width of the first output current $IDD_{MID}$, on the basis of a second control signal CNT2.

Further, the switching element 901 is supplied with the first output current $IDD_{MID}$ and square waves, serving as the second control signal CNT2. The square waves are supplied from the outside. The switching element 901 constitutes a pulse width modulating circuit, and is turned on or off by the second control signal.

Next, the operation of the second power supply circuit 900 will be described below.

The switching element 901 modulates the pulse of the first output current $IDD_{MID}$ according to the duty of the second control signal CNT2, and outputs the pulse modulated current as an LED driving current $IDD_{OUT}$.

Figure 10:
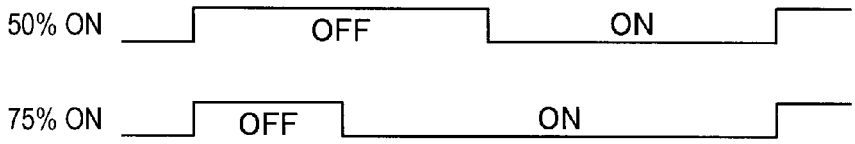
FIG. 10 is a diagram illustrating the relationship between a control signal and an output current of a switching element.

FIG. 10 is a diagram illustrating the relationship between the second control signal CNT2 and the current $IDD_{OUT}$ output from the switching element 901. For example, in a case in which the switching element 901 is of a p-channel transistor, the switching element 901 is turned on when the second control signal CNT2 having a low level is supplied. In this case, a current flows through the switching element 901. When a period where the second control signal CNT2 is at the low level is 50% of the entire period, the LED driving current $IDD_{OUT}$ is adjusted to 50% of the first output current $IDD_{MID}$. In addition, when a period where the second control signal CNT2 is at the low level is 75% of the entire period, the LED driving current $IDD_{OUT}$ is adjusted to 75% of the first output current $IDD_{MID}$.

The LED driving circuit 120 includes the second power supply circuit 900 according to the third embodiment of the invention, and thus has the following advantages. The LED driving circuit 120 can set an output current to be smaller than an input current, and output it as an LED driving current, which makes it possible to minutely adjust the LED driving current.

According to this embodiment, the following advantages are obtained. The first power supply circuit 800 generates a current that is n times (n is an integer) larger than an input voltage, and the second power supply circuit 900 sets, as an LED driving current, a current smaller than the generated current. Therefore, this structure makes it possible to minutely adjust the LED driving current over a wide range. In addition, this structure makes it possible to further decrease the number of ineffective circuits and thus to reduce the overall size of a circuit, as compared with the conventional structure in which a one-stage power supply circuit is used.

Modifications

The invention is not limited to the above-described embodiments, but modifications and changes of the invention can be made without departing from the scope and spirit of the invention. For example, the invention may include a structure in which the components are provided in different orders from those in the above-described embodiments. In addition, the invention may include a combination of the above-described embodiments.

For example, three or more power supply circuits may be connected to each other through input nodes and output nodes.

Electro-Optical Device

Figure 11:
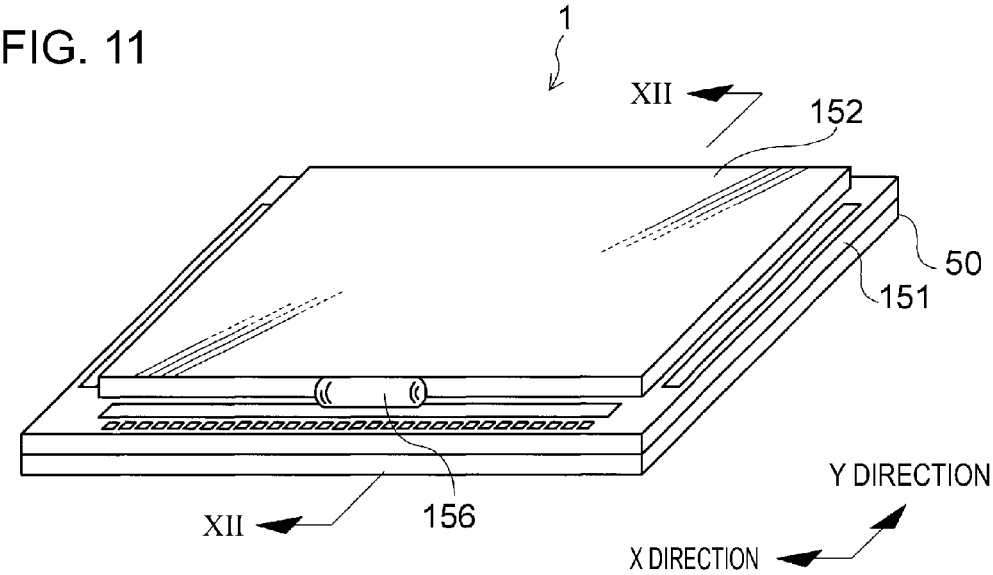
FIG. 11 is a perspective view illustrating the structure of an electro-optical device according to a fourth embodiment of the invention.
Figure 12:
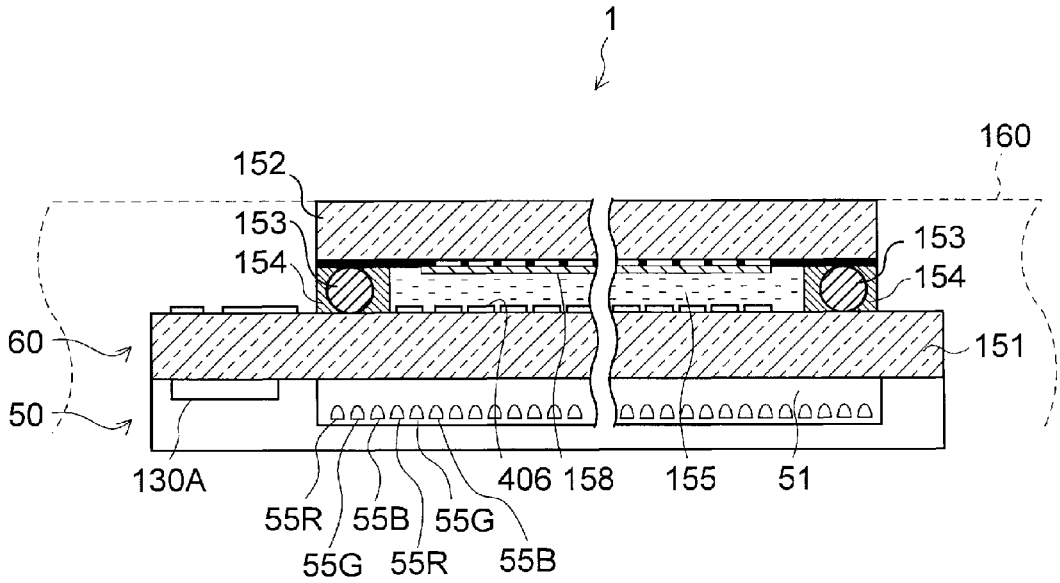
FIG. 12 is a cross-sectional view illustrating the structure of the electro-optical device, taken along the line XII-XII' of FIG. 11.

FIG. 11 is a perspective view illustrating the structure of an electro-optical device 1 according to a fourth embodiment of the invention. FIG. 12 is a cross-sectional view taken along the line XII-XII' of FIG. 11. The electro-optical device 1 is accommodated in a case 160 (which is represented by dashed lines in FIG. 12). The electro-optical device 1 includes a liquid crystal panel 60 and a backlight 50. The liquid crystal panel 60 includes an element substrate 151, serving as a first substrate, having, for example, pixel electrodes 406 formed thereon, a counter substrate 152, serving as a second substrate, which is opposite to the element substrate 151 and has, for example, a common electrode 158 formed thereon, and liquid crystal 155, serving as an electro-optical material, which is provided between the element substrate 151 and the counter substrate 152. The element substrate 151 is formed of, for example, glass or semiconductor, and various circuits using TFTs (thin film transistors) are formed on the element substrate 151. In addition, the counter substrate 152 is formed of a transparent material, such as glass. The backlight 50 is provided below the element substrate 151 (below a surface of the element substrate 151 opposite to the counter substrate 152) and emits light toward the liquid crystal 155. The backlight 50 includes a backlight unit 51 having a plurality of LEDs that have different emission peak wavelengths, for example, LEDs 55R, 55G, and 55B having red, green, and blue emission peak wavelengths, respectively, and an LED driving unit 130A that supplies driving currents to the LEDs 55R, 55G, and 55B of the backlight unit 51. The LED driving circuit 100 according to the first embodiment is provided in an LED driving unit 130A.

A sealing member 154 is provided along the periphery of the counter substrate 152 to seal a gap between the element substrate 151 and the counter substrate 152. The sealing member 154, the element substrate 151, and the counter substrate 152 form a space where the liquid crystal 155 is injected. In addition, spacers 153 are dispersed in the sealing member 154 in order to maintain a uniform gap between the element substrate 151 and the counter substrate 152. Further, an opening for injecting the liquid crystal 155 is formed in the sealing member 154. The opening of the sealing member 156 is sealed after the liquid crystal 155 is injected.

Figure 13:
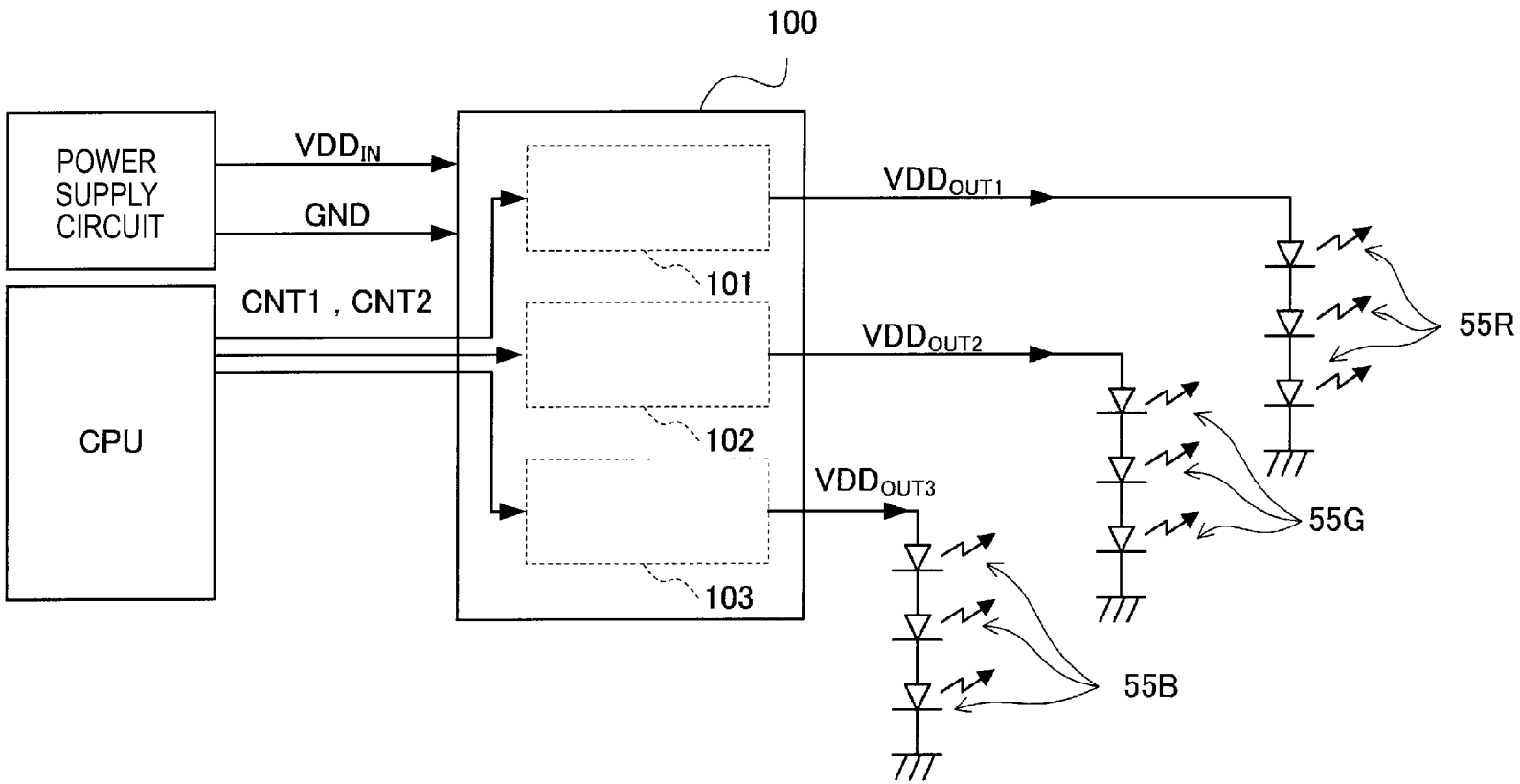
FIG. 13 is a block diagram illustrating the relationship between an LED driving circuit and LEDs.

FIG. 13 is a block diagram illustrating the relationship among the LED driving circuit 100 and the LEDs 55R, 55G, and 55B. A voltage $VDD_{IN}$ and a ground potential GND are supplied from a power supply circuit to the LED driving circuit 100. In addition, the control signal CNT1 and CNT2 are supplied to the LED driving circuit 100 from a CPU of an electronic apparatus, such as a cellular phone, which is provided with the LED driving circuit 100. The LED driving unit circuits 101, 102, and 103 of the LED driving circuit 100 supplies LED driving voltages $VDD_{OUT1}$, $VDD_{OUT2}$, and $VDD_{OUT3}$ to three types of LEDs 55R, 55G, and 55B, respectively. The LED driving circuit 100 controls the LED driving voltages $VDD_{OUT1}$, $VDD_{OUT2}$, and $VDD_{OUT3}$ to be supplied to the LEDs 55R, 55G, and 55B, on the basis of controls signals supplied from the CPU to the LEDs 55R, 55G, and 55B. Therefore, it is possible to minutely adjust colored light emitted from the LEDs 55R, 55G, and 55B.

The electro-optical device 1 includes the backlight 50 provided with the LED driving circuit 100, and thus has the following advantages.

Since the backlight 50 includes the LED driving circuit 100, it is possible to reduce the size of a circuit and to realize a light source emitting high colored light. Therefore, the electro-optical device 1 makes it possible to reduce the size of a circuit, to realize high color reproducibility, and to achieve an improvement in display quality.

Further, the LED driving circuit 100 according to the first embodiment is provided in the LED driving circuit 130A, but the invention is not limited thereto. For example, the LED driving circuit 110 according to the second embodiment, or the LED driving circuit 120 according to the third embodiment may be provided in the LED driving circuit 130A.

Electronic Apparatus

Figure 14:
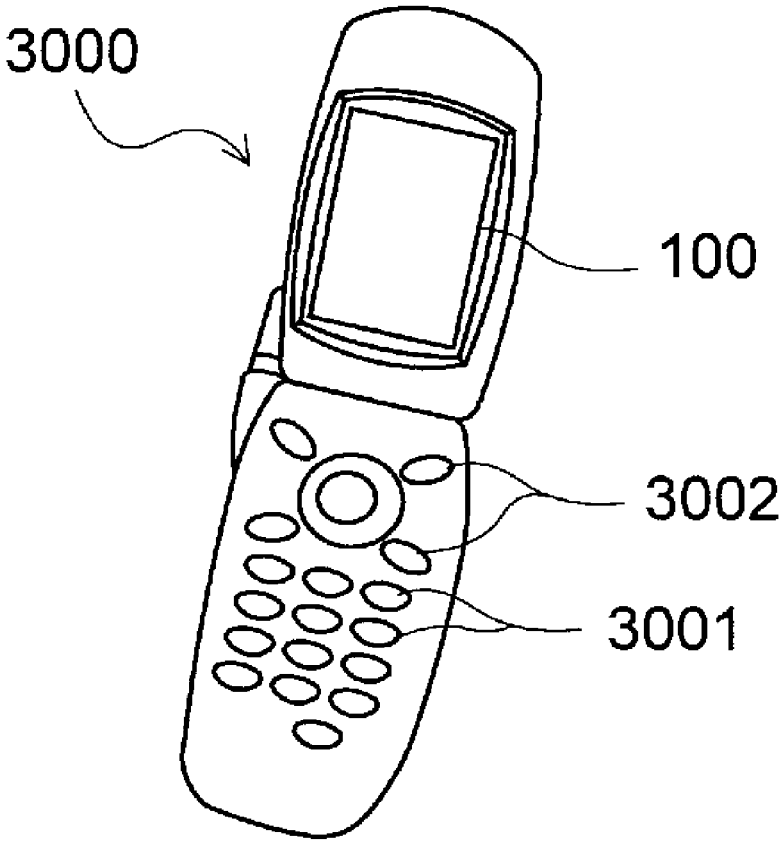
FIG. 14 is a perspective view illustrating the structure of a cellular phone including the electro-optical device.

Next, a description will be made of an electronic apparatus including the electro-optical device 1 according to any one of the above-described embodiments and modifications. FIG. 14 is a perspective view illustrating the structure of a cellular phone provided with the electro-optical device 1. A cellular phone 3000 includes a plurality of operating buttons 3001, scroll buttons 3002, and the electro-optical device 1 serving as a display unit. The operation of the scroll button 3002 causes a screen displayed on the electro-optical device 1 to be scrolled.

What is claimed is:

1. An LED driving circuit for driving a plurality of different backlight LEDs, comprising:

a first power supply circuit that is adapted to be supplied with an input voltage for generating a plurality of driving voltages and a reference voltage with respect to the input voltage and is adapted to generate a first output voltage and a second output voltage from the input voltage, based on a first control signal; and a second power supply circuit that is adapted to be supplied with the first output voltage, the second output voltage, and the reference voltage, the second power supply circuit adapted to select a voltage for driving the backlight LEDs, based on a second control signal, and adapted to output the voltage for driving the backlight LEDs.

2. The LED driving circuit according to claim 1, wherein the first power supply circuit includes:

a booster unit that is adapted to raise the input voltage with respect to the reference voltage to generate a plurality of driving voltages; and a voltage selecting unit that is adapted to select the first output voltage and the second output voltage from the reference voltage and the plurality of driving voltages supplied from the booster unit and output the selected voltages.

3. The LED driving circuit according to claim 1, wherein the first power supply circuit includes:

a voltage dividing unit that is composed of a resistor ladder circuit having a plurality of resistors connected in series to each other and adapted to divide a voltage into a plurality of driving voltages in the range of the input voltage and the reference voltage, both ends of resistor ladder circuit adapted to be supplied with the input voltage and the reference voltage; and a voltage selecting unit that is adapted to select the first output voltage and the second output voltage from the reference voltage and the plurality of driving voltages supplied from the voltage dividing unit and output the selected voltages.

4. The LED driving circuit according to claim 1, wherein the second power supply circuit includes:

a voltage dividing unit that is composed of a resistor ladder circuit having a plurality of resistors connected in series to each other and is adapted to divide a voltage into a plurality of voltages in the range of the first output voltage and the second output voltage, both ends of the resistor ladder circuit adapted to be supplied with the first output voltage and the second output voltage; and a voltage selecting unit that is adapted to select the voltage for driving the backlight LEDs from the plurality of voltages supplied from the voltage dividing unit, based on the second control signal and is adapted to output the selected voltage.

5. An illuminating device comprising the LED driving circuit according to claim 1.

6. An electro-optical device comprising:

the illuminating device according to claim 5; and an electro-optical panel.

7. An LED driving circuit that drives a plurality of different LEDs, comprising:

a first power supply circuit that is adapted to be supplied with an input voltage for generating a plurality of driving currents and a reference voltage with respect to the input voltage and adapted to generate a first output current from the input voltage, based on a first control signal; and a second power supply circuit that is adapted to be supplied with the first output current and the reference voltage and adapted to output a current for driving the LEDs, based on a second control signal, the second power supply circuit including a pulse width modulating circuit that has a switching element, and is adapted to modulate the pulse width of the first output current based on square waves that are su lied to the switching element as the second control signal, to output the current for driving the LEDs.

8. The LED driving circuit according to claim 7, wherein the first power supply circuit includes:

a current amplifying unit that is composed of a current mirror circuit having a plurality of transistors, gates of the plurality of transistors connected to each other, the current minor circuit adapted to be supplied with the input voltage; and a current control unit that is adapted to control currents output from the current amplifying unit by using a plurality of transistors and adapted to output the sum of the controlled currents as a first output current.

* * * * *